US007466529B2

(12) United States Patent
Joung

(10) Patent No.: US 7,466,529 B2
(45) Date of Patent: Dec. 16, 2008

(54) COMMUNICATION-CIRCUIT LINE PROTECTOR

(76) Inventor: Jae-Han Joung, 105-2002, Samsung RaeMiAn-Apt., 91-5, Dogok-Dong, Kangnam-gu, Seoul (KR) 135-270

( * ) Notice: Subject to any disclaimer, the term of this patent is extended or adjusted under 35 U.S.C. 154(b) by 0 days.

(21) Appl. No.: 11/511,494

(22) Filed: Aug. 29, 2006

(65) Prior Publication Data

US 2007/0058318 A1 Mar. 15, 2007

(30) Foreign Application Priority Data

Sep. 9, 2005 (KR) ..... 20-2005-0026110 U
Jan. 20, 2006 (KR) ..... 20-2006-0001762 U

(51) Int. Cl.
*H01C 7/12* (2006.01)

(52) U.S. Cl. ..... 361/119; 361/56; 361/111; 361/725; 361/736; 361/753; 361/824

(58) Field of Classification Search ..... 361/56, 361/91.1, 111, 117–120, 725, 736, 753, 824
See application file for complete search history.

(56) References Cited

U.S. PATENT DOCUMENTS 4,313,147 A * 1/1982 Uchida et al. ..... 361/119
4,325,100 A * 4/1982 Baumbach ..... 361/119
4,741,711 A * 5/1988 Singer, Jr. ..... 439/620.26
4,878,852 A * 11/1989 Bertsch et al. ..... 439/103
5,157,580 A * 10/1992 Hegner et al. ..... 361/119
5,546,267 A * 8/1996 Frederiksen et al. ..... 361/119
5,696,820 A * 12/1997 Pelegris et al. ..... 379/413.04
5,844,785 A * 12/1998 Daoud et al. ..... 361/824
5,936,821 A * 8/1999 Busse et al. ..... 361/104
6,031,706 A * 2/2000 Nabell ..... 361/111
6,312,338 B1 * 11/2001 Sato et al. ..... 463/44
7,050,285 B2 * 5/2006 Sato et al. ..... 361/119

* cited by examiner

*Primary Examiner*—Michael J Sherry
*Assistant Examiner*—Terrence R Willoughby
(74) *Attorney, Agent, or Firm*—Roberts Mlotkowski Safran & Cole, P.C.; Thomas W. Cole

(57) ABSTRACT

A communication-circuit line protector capable of maintaining reliable connection to a port unit of a communication system, easily checking a disorder or failure of the communication-circuit line protector, and effectively releasing heat generated from an inner portion of the communication-circuit line protector is provided. The communication-circuit line protector include: a housing having a plurality of openings disposed on a side thereof; a ground pin provided to an inner side of the housing, the ground pin having an elastic end portion which cooperates with a lower-side inner wall of the housing opposite thereto to be in close contact with a ground portion, thereby maintain reliable ground contact; and a PCB having the ground pin attached to one side thereof and a conduction member provided to a lower end portion thereof, thereby maintaining good connection at a time of connection to a port.

3 Claims, 8 Drawing Sheets

[fig1]
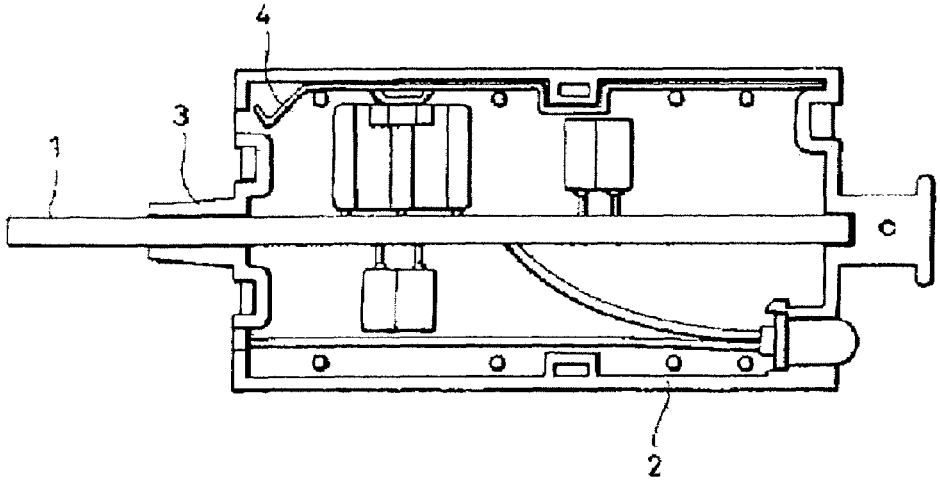
PRIOR ART

【fig2】
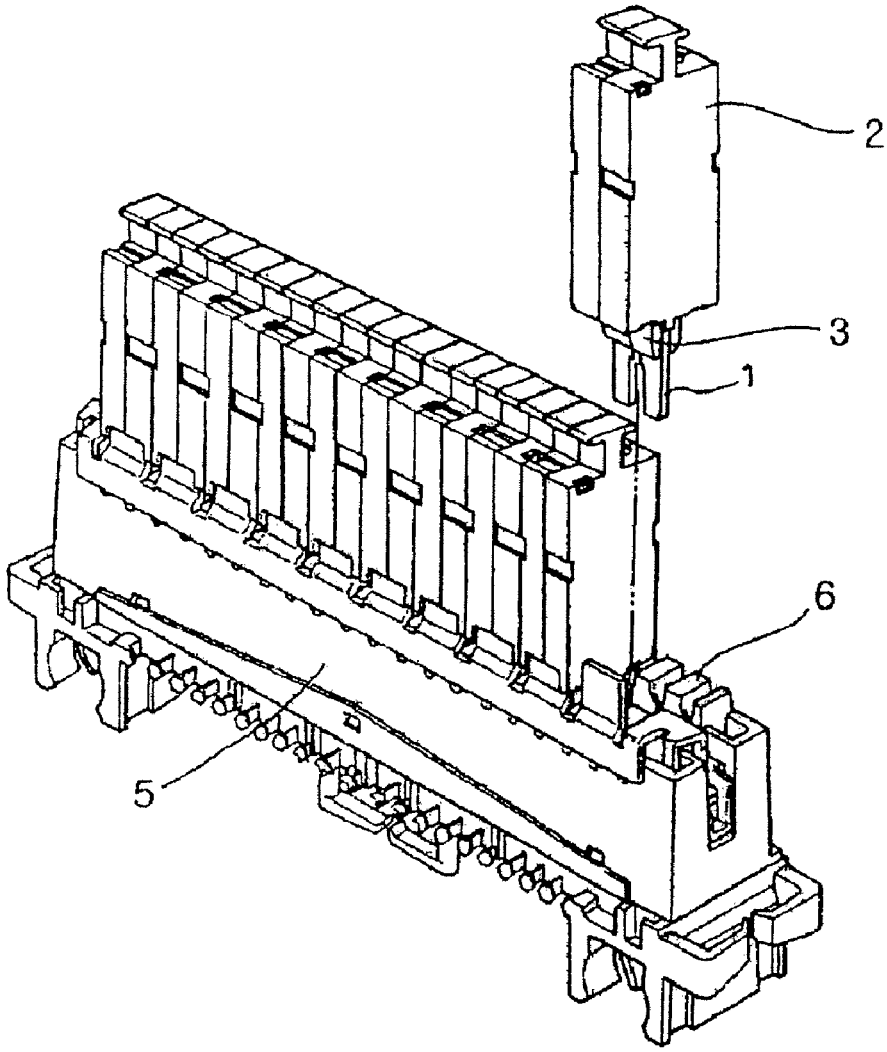
PRIOR ART

[fig3a]
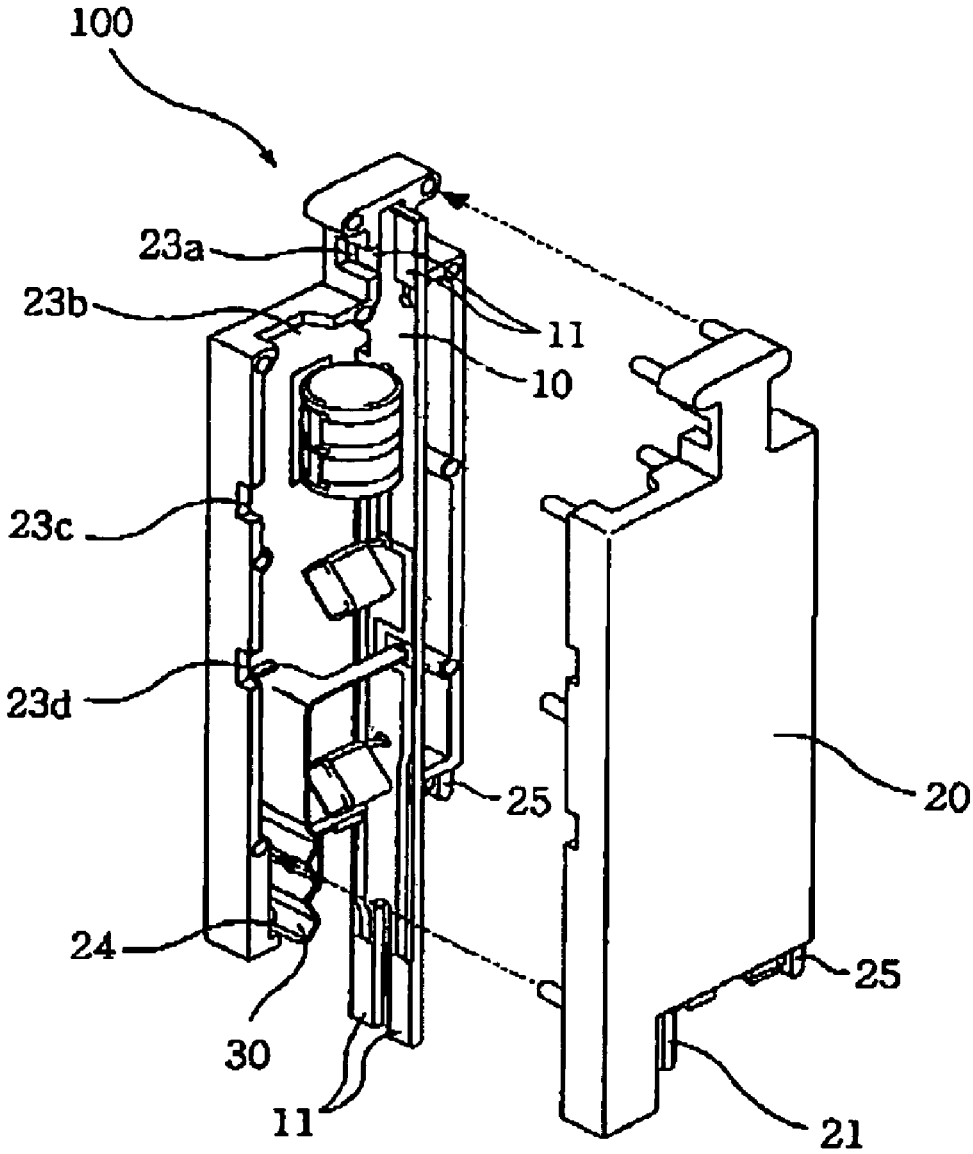

[fig3b]
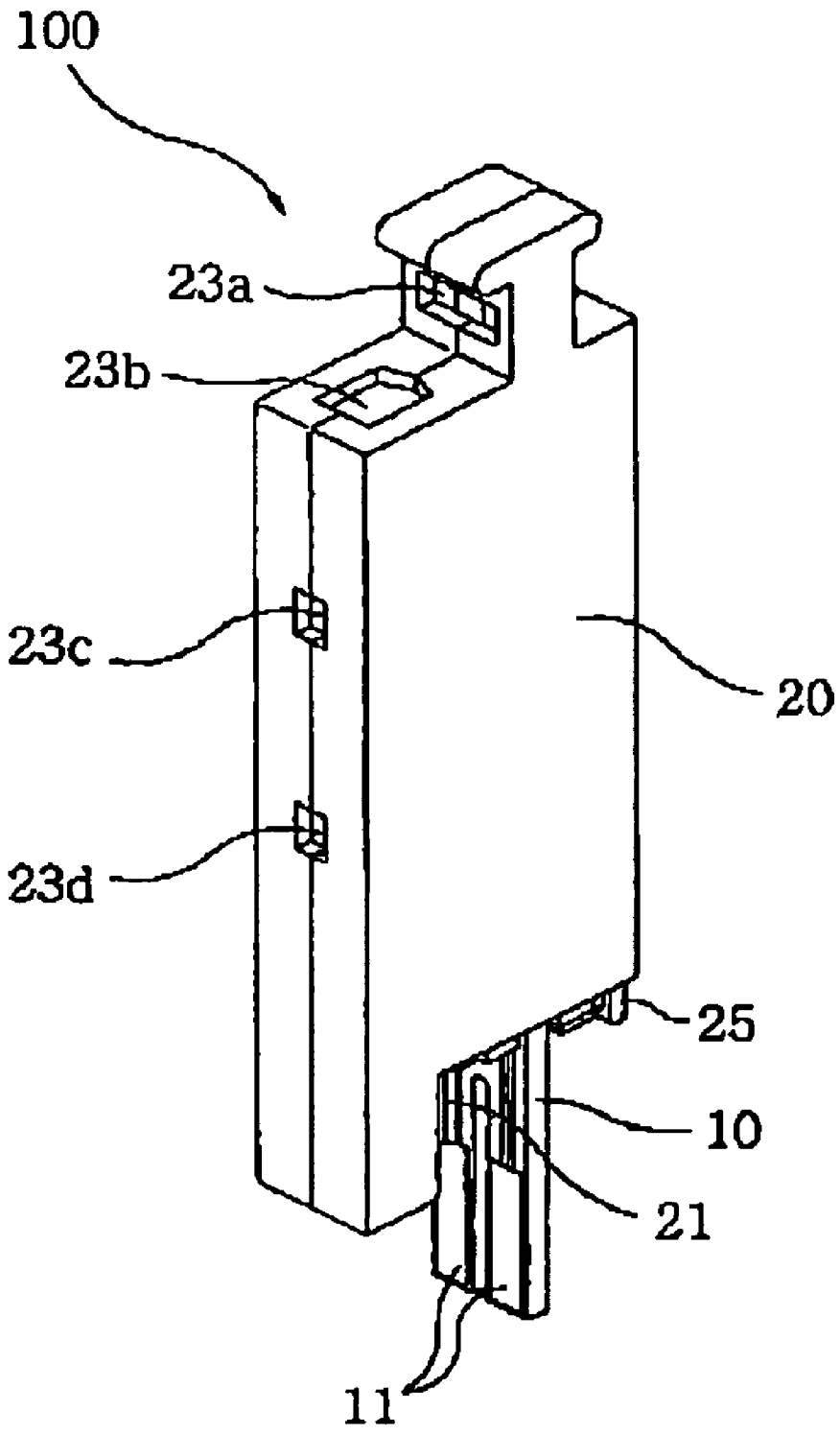

[fig4]
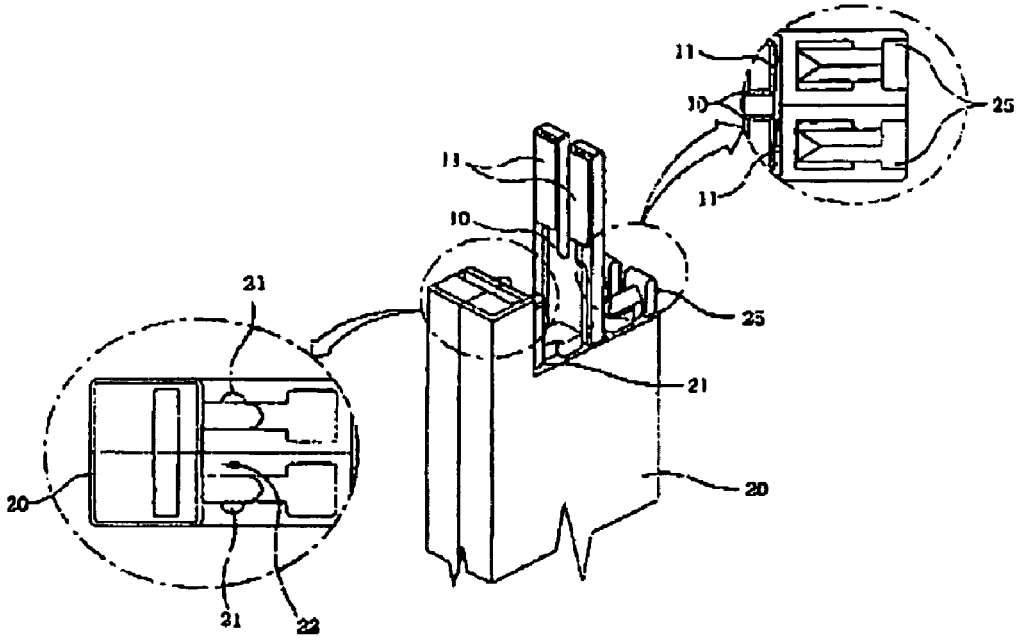

[fig5]
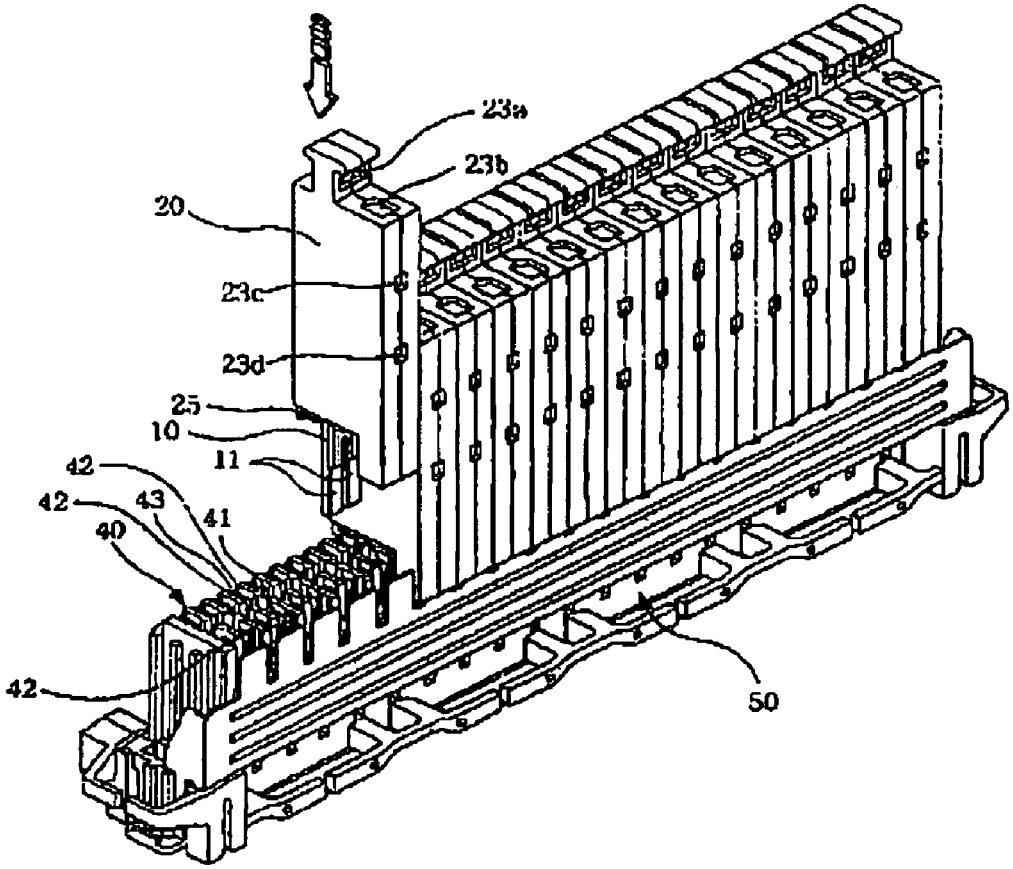

【fig6】
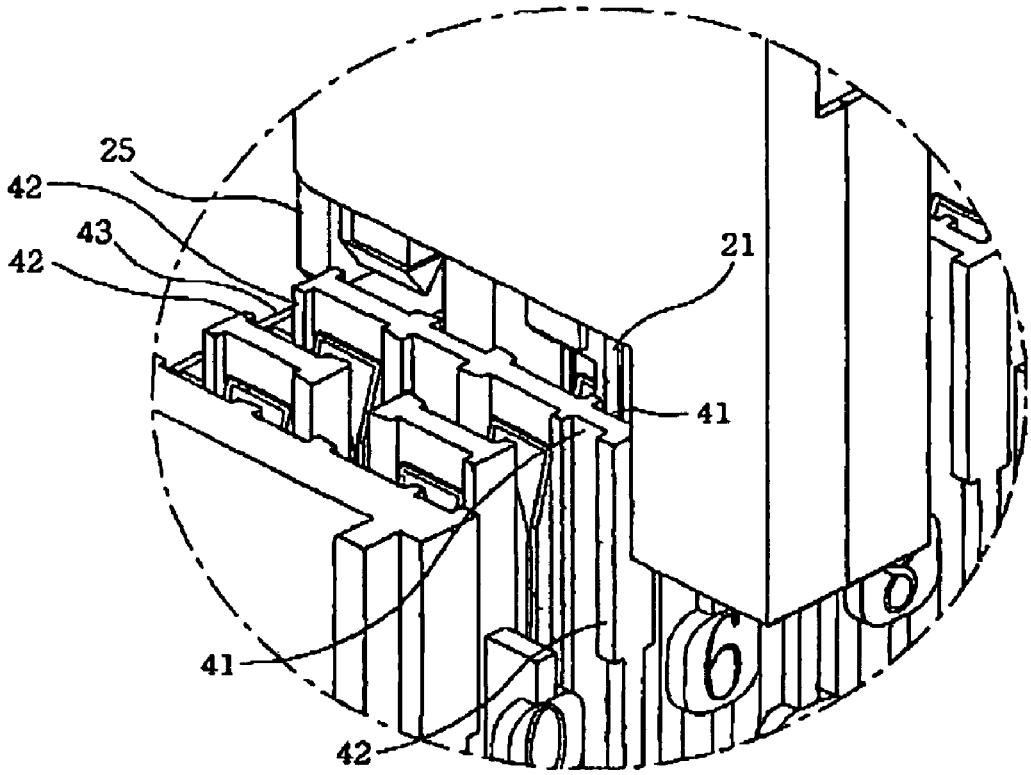

[fig7]
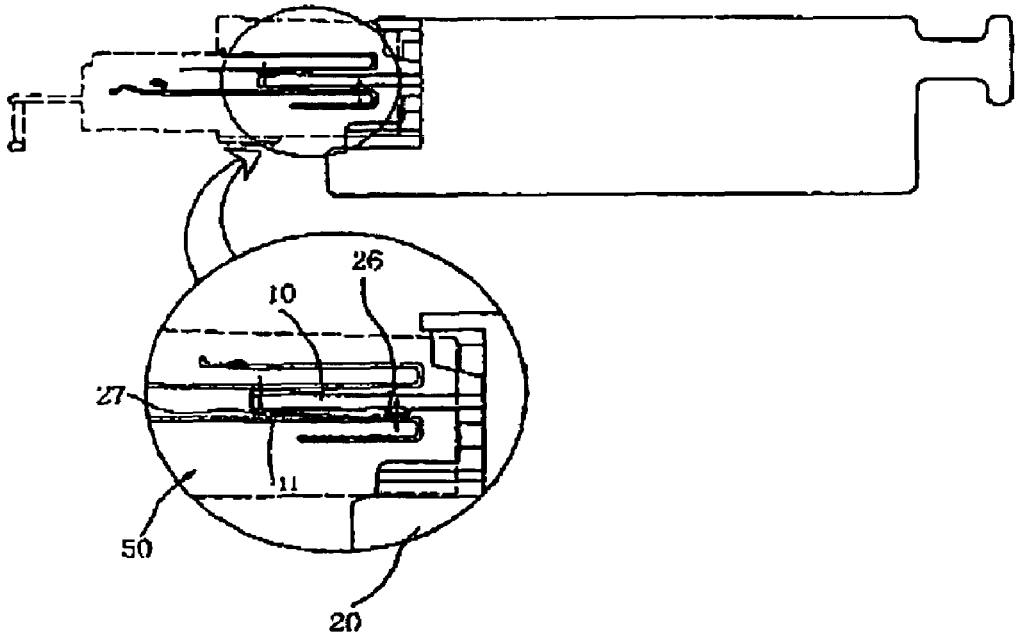

COMMUNICATION-CIRCUIT LINE PROTECTOR

CROSS-REFERENCES TO RELATED PATENT APPLICATION

This application claims the benefits of Korean Utility Model Application No 20-2005-0026110, filed on Sep. 9, 2005, and Korean Utility Model Application No. 20-2006-0001762, filed on Jan. 20, 2006 respectively in the Korean Intellectual Property Office, the disclosures of which are incorporated herein in their entireties by reference.

BACKGROUND OF THE INVENTION

1. Field of the Invention

The present invention relates to a communication-circuit line protector, and more particularly, to a communication-circuit line protector capable of maintaining reliable connection to a port unit of an apparatus in a communication system, easily checking a disorder or failure of the communication-circuit line protector, and effectively releasing heat generated from an inner portion of an housing of the communication-circuit line protector.

2. Description of the Related Art

Generally, in a communication network system, a communication-circuit line protector is connected to a port unit of an apparatus in the communication system so as to protect the apparatus from external surge current and voltage.

The communication-circuit line protector includes a surge current limiting device for limiting the external surge current and a surface voltage blocking device for blocking the surge voltage generated from lightening or the like so as to protect the apparatus in the communication network system.

As shown in FIGS. 1 and 2, a conventional communication-circuit line protector is constructed with a housing 2 which contains various electric elements and a printed circuit board (hereinafter, referred to as a PCB) 1. On side of the PCB 1 is provided with a ground pin 4 which is connected to a circuit line.

A connecting member 3 is disposed to a lower end of the housing 2 so as to be connected to one of ports 6 of a port unit 2.

In such a conventional communication-circuit line protector, means for releasing heat generated from an inner portion of the housing 2 is not provided. Therefore, the generated heat cannot be released, so that the communication-circuit line protector may not perform a normal function.

In addition, means for checking a disorder or failure of the communication-circuit line protector before the time of delivering or at the time of using the communication-circuit line protector is not provided. Therefore, in order to check the disorder or failure, the housing 2 needs to be dissembled. As a result, the checking time increases, and productivity is lowered.

In addition, a robust connecting structure is not provided to the connecting member 3 so as to prevent a separation and a contact failure at the time of connection between the communication-circuit line protector and the port 6 of the port unit. At the time of use, since the separation from the port 6 or the contact failure may occur, the external surge current and voltage easily flow into the communication line, so that the communication line or system may be in environments causing various failure and emergence.

SUMMARY OF THE INVENTION

In order to solve the aforementioned problems, the present invention provides a communication-circuit line protector capable of easily checking a disorder or failure of the communication-circuit line protector before the time of delivering or at the time of using the communication-circuit line protector, rapidly and effectively releasing heat generated from an inner portion of a housing of the communication-circuit line protector, and maintaining close, reliable connection to a port of a port unit.

According to an aspect of the present invention, there is provided a communication-circuit line protector comprising: a housing having a plurality of openings disposed on a side thereof; a ground pin provided to an inner side of the housing, the ground pin having an elastic end portion which cooperates with a lower-side inner wall of the housing opposite thereto to be in contact with a ground portion; and a PCB having the ground pin attached to one side thereof and a conduction member provided to a lower end portion thereof.

In the above aspect of the present invention, the communication-circuit line protector may further comprise an elastic contact member disposed to protrude from a surface of the PCB.

In addition, a connecting protrusion and a connecting groove may be disposed to a lower portion of the housing.

In addition, an auxiliary connecting member may be disposed to one side of a lower portion of the housing.

In the communication-circuit line protector according to the present invention, since a plurality of the openings are disposed on a side of the housing, it is possible to easily check a disorder or failure of the communication-circuit line protector before the time of delivering or at the time of using the line protector by using the openings, and it is possible to effectively release heat generated from an inner portion of the housing of the communication-circuit line protector through the openings.

In addition, since the elastic member is additionally disposed to protrude from one side of the PCB, the conduction member can be connected to the port with a more increased contact strength, so that it is possible to effectively reduce heat caused from an ohmic resistance of a contact portion, and it is possible to primarily block heat conduced when internal temperature of the communication-circuit line protector increases.

In addition, since the connecting protrusion and the connecting groove disposed in the housing are connected to the connecting means disposed in the port of the port unit, it is possible to effectively prevent a separation and a contact failure between the communication-circuit line protector and the port and a contact failure therebetween at the time of connection between the communication-circuit line protector and the port of the port unit.

In addition, since the auxiliary connecting member is disposed to a lower portion of the housing, it is possible to more forcibly connect the communication-circuit line protector and the port of the port unit.

BRIEF DESCRIPTION OF THE DRAWINGS

The above and other features and advantages of the present invention will become more apparent by describing in detail exemplary embodiments thereof with reference to the attached drawings in which:

FIG. 1 is a view showing a conventional communication-circuit line protector;

FIG. 2 is a view showing a state where conventional communication-circuit line protectors are connected to ports provided to a port unit;

FIG. 3*a* is an exploded view of a communication-circuit line protector according to an embodiment of the present invention;

FIG. 3*b* is an assembled view of the communication-circuit line protector according to the embodiment of the present invention;

FIG. 4 is a detailed view showing a connecting protrusion and a connecting groove disposed in a lower portion of the communication-circuit line protector according to the embodiment of the present invention;

FIG. 5 is a view showing a state where the communication-circuit line protectors according to the embodiment of the present invention are connected to ports provided to a port unit;

FIG. 6 is a detailed enlarged view showing the state where one of the communication-circuit line protectors according to the embodiment of the present invention is connected to the corresponding port; and FIG. 7 is a view showing a state where a communication-circuit line protector having an additional elastic contact member disposed is on one surface of a PCB according to another embodiment of the present invention is connected to a port.

DETAILED DESCRIPTION OF THE INVENTION

Hereinafter, preferred embodiments of the present invention are described with reference to the accompanying drawings. FIG. 3*a* is an exploded view of a communication-circuit line protector according to an embodiment of the present invention. FIG. 3*b* is an assembled view of the communication-circuit line protector according to the embodiment of the present invention. FIG. 4 is a detailed view showing a connecting protrusion and a connecting groove disposed in a lower portion of the communication-circuit line protector according to the embodiment of the present invention. FIG. 5 is a view showing a state where the communication-circuit line protectors according to the embodiment of the present invention are connected to ports provided to a port unit.

As shown in FIGS. 3*a* to 5, the communication-circuit line protector 100 according to the embodiment of the present invention includes openings 23*a*, 23*b*, 23*c*, and 23*d*. The openings 23*a*, 23*b*, 23*c*, and 23*d* are provided at a side of a housing 20 and are used to check a disorder of the line protector 100 and effectively release heat generated from an inner portion of the line protector 100.

Preferably, the openings 23*a*, 23*b*, 23*c*, and 23*d* of the housing 20 are disposed to positions suitable to easily check conduction patterns of a PCB 10 and short-circuit or a normal operating state of elements and circuits thereof.

A ground pin 30 provided to one side of the PCB 10 is an elastic member. The one end of the ground pin 30 is provided with a plurality of convex-concave portions. The convex-concave portions cooperates with a lower-side inner wall 24 of the housing 20 opposite thereto to be in close contact with a ground portion (not shown) to maintain close, reliable ground contact.

Conduction members 11 are disposed on two lower-side surfaces of the PCB 10, so that good conduction is maintained at the time of connection between the line protector 100 and the port.

A connecting protrusion 21 and a connecting groove 22 are disposed to a lower portion of the housing 20 so as to allow the line protector 100 to be easily and accurately connected to the port 40 having a connecting protrusion 41 and a connecting 42 disposed to the portion unit 50. The connecting groove 22 and the connecting protrusion 21 may be modified in various shapes suitable to shapes of the connecting protrusion 41 and the connecting 42 of the port 40.

An auxiliary connecting member 25 may be disposed to a lower-side portion of the housing 20 so as to allow the line protector 100 to be more closely connected to the port 40.

Now, operations of the communication-circuit line protector having the aforementioned construction according to the embodiment of the present invention are described in detail. The communication-circuit line protector 100 is constructed by disposing the PCB 10 including various electric circuits or the like in the housing 20 which can be divided into two opposite parts with respect to the central line thereof, forming the ground pin 30 on the one-side portion of the PCB 10, and assembling the two opposite parts.

In the assembled housing 20 having the aforementioned construction, the openings 23*a*, 23*b*, 23*c*, and 23*d* are disposed to the positions suitable to easily check the normal operation state of the electric elements and circuits disposed on the PCB 10. Therefore, by inserting a probe (not shown) of a test apparatus into the openings 23*a*, 23*b*, 23*c*, and 23*d*, it is possible to check the connection state and the operating state of the electric elements and circuits and short-circuit of contacts. As a result, it is possible to speedily and easily check a disorder of the line protector 100 before the time of delivering or at the time of using the line protector 100. In addition, it is possible to rapidly and easily release heat generated from the elements formed on the PCB 10 in the inner portion of the housing 20, so that it is possible to prolong the life cycle of the line protector 100 and maintain the line protector 100 in a good operating state.

In addition, in the state where the line protector 100 is connected to the port 40, the ground pin 30 provided at the one side of the PCB 10 is designed to elastically support a ground portion (not shown). Therefore, it is possible to more effectively protect the line protector 100 from external surge current and voltage.

More specifically, since the lower end of the ground pin 30 is provided with a plurality of the aforementioned convex-concave portions, the ground portion (not shown) can be elastically supported by a plurality of the convex-concave portion at plural positions at the time of connection between the line protector 100 and the port 40. Therefore, the ground pin 30 can be connected to the ground portion with a strong connection force.

Unlike a convention line protector where a ground pin is fixed by using soldering, in the embodiment of the present invention, the ground pin 30 is inserted and assembled into the inner portion of the housing 20. Therefore, the line protector can be manufactured with good workability.

Particularly, according to the embodiment of the present invention, since the conduction portions 11 are disposed on the two surfaces of the PCB 10 which is inserted and fixed in the inner portion of the housing 20, good conduction can be obtained irrespective of connection directions, for example, a reverse direction at the time of connection between the line protector 100 and the port 40. Therefore, it is possible to increase compatibility of product and a degree of freedom in use of the product.

Moreover, according to the embodiment of the present invention, the connecting protrusion 21 and the connecting groove 22 are disposed to the lower portion of the housing 20, and the connecting protrusion 21 and the connecting groove 22 are inserted into the connecting groove 42 and the connecting protrusion 41 of the port 40 at the time of connection between the line protector 100 and the port 40 without a gap therebetween, so that it is possible to maintain a reliable connection state. More specifically, the connecting protrusion 21 and the connecting groove 22 of the housing 20 are constructed to be engaged with the connecting groove 42 and the connecting protrusion 41 in a convex-convex engagement manner without a gap therebetween, so that a separation between these members can be prevented. Therefore, it is possible to effectively increase an engaging or fixing force therebetween.

In addition, the auxiliary connecting member 25 disposed to the lower-side portion of the housing 20 is inserted into a connecting groove 43 formed between the connecting protrusions 42 of the 40 at the time of connection between the line protector 100 and the port 40, so that the engagement in the edge direction can be more strongly implemented. Therefore, although external impact or vibration is exerted to the line protector 100, a reliable connection state thereof can be maintained.

Now, another embodiment of the present invention is described with reference to FIG. 7. According to the embodiment of the present invention, an additional elastic contact member 26 which protrudes from the side portion of the conduction member 11 is provided to an upper portion of the conduction member 11 disposed on the lower-side surface of the PCB 10. Due to the elastic contact member 26, the conduction member 11 can be more forcibly inserted into the port 40 with a strong contact force. Therefore, a contact strength of the end portion of the conduction member 11 increase, so that heat caused from ohmic contact resistance can be reduced. Moreover, due to the elastic contact member 26, when internal temperature of the line protector 100 increases, heat conducted from the line protector 100 can be primarily blocked.

FIG. 7 is a view showing a state where the communication-circuit line protector 100 having the elastic contact member 26 according to the embodiment of the present invention is connected to the port 40. As shown in FIG. 7, due to the elastic contact member 26, the PCB 10 is lifted in the upward direction represented by the right-side arrow shown in the figure, and the end portion of the conduction member 11 is lifted in the downward direction represented by the left-side arrow shown in the figure. Therefore, the conduction member 11 of the PCB 10 is constructed to press an elastic ground member 27 of the port 40. As a result, the contact area increases, so that the ohmic contact resistance can be reduced.

In addition, due to the elastic contact member 26, the conduction member 11 is in uniform contact with the elastic ground member 27, so that the contact area can increase. Therefore, the ohmic resistive heat generated from the contact position can be efficiently reduced. Moreover, according to the embodiment of the present invention, due to the elastic contact member 26, the contact fore of the conduction member 12 can increase, and the connecting force of the housing 20 can increase at the time of connection between the line protector 100 and the port unit 50.

According to the present invention, it is possible to speedily, simply, and easily check a disorder or a normal operating state of a communication-circuit line protector before the time of delivering or at the time of using the line protector. In addition, it is possible to effectively release heat generated from an inner portion of the line protector.

According to the present invention, since an elastic member is disposed to protrude from one side of a PCB, a ground surface of a conduction member can be pressed with a strong pressure, so that it is possible to effectively reduce ohmic resistive heat at the ground surface.

According to the present invention, it is possible to effectively prevent a separation between a housing and a port and a contact failure therebetween at the time of connection between the communication-circuit line protector and the port.

According to the present invention, it is possible to more forcibly connect the housing of the communication-circuit line protector and the port.

While the present invention has been particularly shown and described with reference to exemplary embodiments thereof, it will be understood by those skilled in the art that various changes in form and details may be made therein without departing from the spirit and scope of the invention as defined by the appended claims. The exemplary embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. A communication-circuit line protector comprising:

a housing;

a ground pin provided to an inner side of the housing, the ground pin having an elastic end portion which cooperates with a lower-side inner wall of the housing opposite thereto to be in contact with a ground portion; and a PCB having the ground pin attached to one side thereof and a conduction member provided to a lower end portion thereof, and an elastic contact member disposed to protrude from a surface of the PCB so that, when said communication-circuit line protector is inserted to a port of a port unit, said conduction member is pushed to said port, thereby increasing contact between the conduction member and the port, wherein said housing includes a plurality of openings disposed on a side thereof that release heat from an inner portion of the housing and enable access to and inspection of said PCB, and wherein said conduction member is disposed on two surfaces of the PCB in order to obtain good conduction and compatibility.

2. The communication-circuit line protector according to claim 1, wherein a connecting protrusion and a connecting groove are disposed to a lower portion of the housing.

3. The communication-circuit line protector according to claim 1, wherein an auxiliary connecting member is disposed to one side of a lower portion of the housing.

* * * * *